United States Patent [19]

Baker et al.

[11] Patent Number: 4,925,586

[45] Date of Patent: May 15, 1990

[54] POUCHED GRANULAR DETERGENT COMPOSITIONS CONTAINING HYGROSCOPIC BUILDERS

[75] Inventors: Keith H. Baker; Stephen W. Snyder; Allen D. Clauss, all of Cincinnati, Ohio

[73] Assignee: The Procter & Gamble Company, Cincinnati, Ohio

[21] Appl. No.: 355,044

[22] Filed: May 15, 1989

Related U.S. Application Data

[63] Continuation of Ser. No. 148,727, Jan. 26, 1988, abandoned.

[51] Int. Cl.[5] ..... C11D 17/00; C11D 7/08

[52] U.S. Cl. ..... 252/90; 252/92; 252/142; 252/144; 252/174.19; 252/179

[58] Field of Search ..... 252/90, 92, 174.19, 252/142, 144, 179

[56] References Cited

U.S. PATENT DOCUMENTS

| | | | |
|---|---|---|---|
| 3,929,678 | 12/1975 | Laughlin et al. | 252/526 |
| 4,555,354 | 11/1985 | Clarke | 252/90 |
| 4,612,137 | 9/1985 | Kuroda | 252/174.19 |
| 4,638,907 | 1/1987 | Bedenk et al. | 252/93 |
| 4,663,071 | 5/1987 | Bush et al. | 252/174.19 |
| 4,689,167 | 8/1987 | Collins | 252/95 |
| 4,740,326 | 4/1988 | Hortel et al. | 252/90 |

*Primary Examiner*—A. Lionel Clingman

*Attorney, Agent, or Firm*—Leonard Williamson; Robert B. Aylor; Richard C. Witte

[57] ABSTRACT

A porous, pouched granular detergent compositions containing an organic surfactant, preferably an aluminosilicate ion exchange material, and water-soluble neutral or alkaline hygroscopic detergency builder salt, preferably an ether polycarboxylate. The pouched compositions contain no or low levels of phosphate and silicate materials, yet provide granules which exhibit at least initial free-flowing granular characteristics, reduced dusting and unexpectedly good/equivalent solubility in the laundering solution notwithstanding the development of lumps upon storage under stress conditions.

10 Claims, 2 Drawing Sheets

POUCHED GRANULAR DETERGENT COMPOSITIONS CONTAINING HYGROSCOPIC BUILDERS

This is a continuation of application Ser. No. 07/148,727, filed on Jan. 26, 1988, now abandoned.

TECHNICAL FIELD

The present invention relates to pouched granular detergent compositions containing a detergent surfactant, preferably an aluminosilicate ion exchange material, water-soluble neutral or alkaline hygroscopic builder salt, preferably comprising ether carboxylate builders as defined herein. The compositions herein, can contain no or only low levels of phosphate materials and preferably less than about 4% by weight of alkali metal silicate materials.

BACKGROUND OF THE INVENTION

Granular detergent compositions have, in the past, often contained high concentrations of phosphate builder materials, particularly sodium tripolyphosphate. When a crutcher mix containing sodium tripolyphosphate is spray-dried, it is believed that enough mixed-phosphate hydrolysis products are formed to inhibit phosphate crystal growth. The hydrolysis products are concentrated in the liquid phase which finally dries to an amorphous glassy phosphate material. This glassy material effectively "cements" the finely crystalline granule walls together, producing granules which exhibit very desirable physical properties, i.e., crisp, durable and free-flowing granules. Moreover, the glassy phosphate material readily disintegrates in the laundering solution so that no insoluble residue is left on the fabrics.

Alkali metal silicates are usually included in granular detergents at low levels for corrosion inhibition and processing reasons. When phosphate builders are removed from detergents, the level of silicate is often increased severalfold since it also dries to a tough glassy film capable of strengthening granule walls and enhancing free-flowing characteristics. Silicates having a lower $SiO_2$ to alkali metal oxide ratio (e.g., 1.6–2.0) are usually selected because they are more water-soluble than the higher ratio silicates. However, exposure of the silicate to carbon dioxide during drying and storage can shift its ratio to a higher value and reduce its solubility, resulting in detergent granules which do not completely disintegrate in the laundering solution, and an unacceptably high level of insoluble material being deposited on fabrics. The insolubles problem can be particularly severe when the detergent composition also contains water-insoluble aluminosilicate material since higher levels of silicates (e.g., above about 3%) enhance the deposition of the aluminosilicates onto fabrics. This solubility problem is compounded further in a pouched detergent form product.

An annoying problem with air/water-permeable pouched granular detergent is dusting when the pouch is removed from its package for use in the washing machine.

The use of hygroscopic builders, particulatly at higher levels, can improve granular detergent solubility. However, they have been avoided in granular form due to granular stickiness and caking upon storage. Detergent stickiness and caking are usually associated with decreased solubility and undesirable flow properties.

SOME OBJECTS OF THE PRESENT INVENTION

It is therefore an object of the present invention to provide a pouched laundry hygroscopic granular detergent composition dispenser that is disposable in nature and which will dispense the laundry detergent in a simple and efficient manner during the wash period of an automatic clothes washing machine.

Another object of the present invention is to provide a porous pouched laundry detergent dispenser with reduced dusting.

SUMMARY OF THE INVENTION

Figure 2:
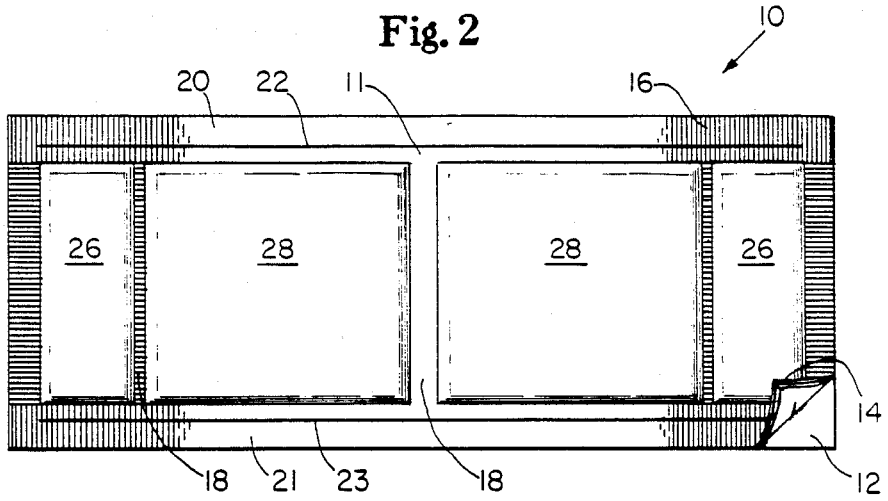
FIG. 2 is a top flat view of the pouched laundry active dispenser of FIG. 1.

The present invention encompasses a porous, pouched hygroscipic granular detergent composition and a method of dispensing said hygroscopic granular detergent into the wash water of a washing machine.

DETAILED DESCRIPTION OF THE INVENTION

The present invention encompasses a porous, pouched hygroscopic granular detergent composition comprising:

(a) from about 5% to about 45% by weight of an organic surfactant selected from the group consisting of anionic, nonionic, zwitterionic, ampholytic and cationic surfactants, and mixtures thereof;

(b) from about 5% to about 75% by weight of water-soluble neutral or alkaline salt comprising from about 1% to about 55%, by weight of the granular detergent composition, of a hygroscopic builder salt selected from the group consisting of: organic salts of citrate, formate, malate, succinate, acetate, tartrate, and ether polycarboxylate builder having the formula:

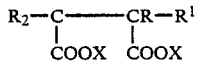

wherein each R is selected from the group consisting of H, and OH with no more than one OH group being attached to any one carbon atom; $R^1$ is either a group having the formula

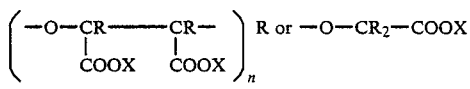

wherein each X is selected from the group consisting of H and cations which make the ether polycarboxylate builder water soluble and n is from 0 to 4; and said composition contains less than about 10% by weight of phosphate materials, said composition being formed by drying a concentrated aqueous slurry comprising the above components; and (c) from 0% to about 30%, preferably from about 5% to about 25%, by weight of a finely divided aluminosilicate ion exchange material selected from the group consisting of:

(1) crystalline aluminosilicate material of the formula:

$$Na_z[(AlO_2)_z \cdot (SiO_2)_y] \cdot xH_2O$$

wherein z and y are at least 6, the molar ratio of z to y is from 1.0 to 0.5 and x is from 10 to 264, said material having a particle size diameter of from about 0.1 micron to about 10 microns, a calcium ion exchange capacity of at least about 200 mg $CaCO_3$ eq./g and a calcium ion exchange rate of at least about 2 grains $Ca^{++}$/gallon/minute/gram/gallon;

(2) amorphous hydrated aluminosilicate material of the empirical formula:

$$M_z(zAlO_2 \cdot ySiO_2)$$

wherein M is sodium, potassium, ammonium, or substituted ammonium, z is from about 0.5 to about 2 and y is 1, said material having a magnesium ion exchange capacity of at least about 50 milligram equivalents of $CaCO_3$ hardness per gram of anhydrous aluminosilicate and a $Mg^{++}$ exchange rate of at least about 1 grain/gallon/minute/gram/gallon; and (3) mixtures thereof, and wherein said composition is at least initially free flowing, but may become caky or paste-like upon storage.

The pouched granular detergent compositions of the present invention contain, as essential components, detergent surfactant and water-soluble neutral or alkaline hygroscopic builder salt selected from ether polycarboxylate builders, hygroscopic organic salts of citrate, formate, malate, succinate, acetate, tartrate, and suitable hygroscopic polyacrylate salts and mixtures thereof.

The compositions preferably contain (1) from 0% to less than about 5%, more preferably less than about 4%, most preferably less than about 3%, by weight of alkali metal silicate materials; and (2) from % to less than about 10%, more preferably less than about 5%, by weight of phosphate materials. Most preferably, the compositions are substantially free of phosphate materials, at least less than 0.5%. A level of silicate of up to about 10, preferably up to about 8 can be included if solubility is not an issue.

The compositions herein are prepared by drying an aqueous slurry comprising the above components. The slurry generally contains from about 25% to about 50% water, whereas the dried granules can contain up to about 15% water, normally initially from about 3% to about 12%. Higher water levels in the slurry give poorer granules. The drying operation can be accomplished by any convenient means, for example, by using spray-drying towers, both countercurrent and co-current, fluid beds, flash-drying towers, both countercurrent and co-current, fluid beds, flash-drying equipment, or industrial microwave or oven drying equipment. Preferably the drying is in a countercurrent spray drying tower. The granular detergents herein exhibit at least initial free-flowing characteristics which are essential for fast line pouching. The presence of hygroscopic and delinquescent builders will cause caking or stickiness particularly upon storage. The ether polycarboxylate builders are readily water-soluble and the granules quickly disintegrate in the laundering solution. Little or no insoluble residue is left on the fabrics. Moreover, the ether polycarboxylate builder is an effective builder.

The granular detergents are uniquely suited for pouched detergent articles and a method of making same. The granular detergents of this invention are free flowing when made and they are filled into the pouches while free flowing, however, they can become sticky and nonfree flowing or lumpy under stress storage conditions which makes them unsuitable for granular detergents in boxes. Surprisingly, notwithstanding increased caking, there is a benefit in reduced dusting with surprisingly about equal solubility of the detergent from the pouch. Thus, the combination allows for the use of a detergent which forms lumps which are otherwise unacceptable for box use. Yet in the present invention, this sticky, lumpy detergent provides a reduced dusting benefit while maintaining good solubility from a pouch.

Water-Soluble Neutral and Alkaline Hygroscopic Salts

The granular detergents of the present invention can contain a total of from about 5% to about 75%, preferably from about 10% to about 60%, and more preferably from about 20% to about 50%, by weight of a water-soluble neutral or alkaline salt. The neutral or alkaline salt has a pH in solution of seven or greater, and can be either organic or inorganic in nature. The salt assists in providing the desired density and bulk to the detergent granules herein. While some of the salts are inert, many of them also function as detergency builder materials in the laundering solution.

Examples of neutral water-soluble salts include the alkali metal, ammonium or substituted ammonium chorides, fluorides and sulfates. The alkali metal, and especially sodium, salts of the above are preferred. Sodium sulfate is typically used in detergent granules and is a particularly preferred salt herein and is used at a level of about 1:1 of the hygroscopic builder salt.

Other useful water-soluble salts include the compounds commonly known as detergent builder materials. Builders are generally selected from the various water-soluble, alkali metal, ammonium or substituted ammonium phosphates, polyphosphates, phosphonates, polyphosphonates, carbonates, silicates, borates, and polyhydroxysulfonates. Preferred are the alkali metal, especially sodium, salts of the above. However, as previously described, the present compositions should preferably contain less than about 5%, preferably less than about 4%, more preferably less than about 3% by weight of silicate materials for optimum solubility and less than about 10%, preferably less than about 5%, by weight of phosphate materials. Most preferably, the compositions are substantially free of phosphates.

Specific examples of inorganic phosphate builders are sodium and potassium tripolyphosphate, pyrophosphate, polymeric metaphosphate having a degree of polymerization of from about 6 to 21, and orthophosphate. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, incorporated herein by reference.

Examples of nonphosphorus, inorganic builders are sodium and potassium carbonate, bicarbonate, sesquicarbonate, tetraborate decahydrate, and silicate having a molar ratio of $SiO_2$ to alkali metal oxide of from about 0.5 to about 4.0, preferably from about 1.0 to about 2.4.

The Hygroscopic Builder Salt

The water-soluble neutral or alkaline hygroscopic builder salts comprise from about 1% to about 55%, preferably from about 3% to about 30%, most preferably from about 5% to about 25%, by weight of the granular detergent composition.

The hygroscopic builder salt is selected from the group consisting of: organic salts of citrate, formate, malate, succinate, acetate, tartrate, and ether polycarboxylate builder having the formula:

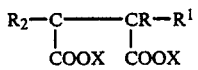

wherein each R is selected from the group consisting of H, and OH with no more than one OH group being attached to any one carbon atom; $R^1$ is either a group having the formula

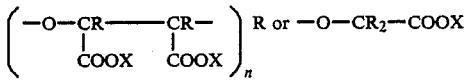

wherein each X is selected from the group consisting of H and cations which make the ether polycarboxylate builder water soluble and n is from 0 to 4.

The preferred hygroscopic builder salts are ether polycarboxylate detergency builders of the general structural formula:

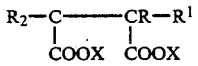

wherein each R is H or OH, so long as only one OH group is attached to a carbon atom, and $R^1$ can be either

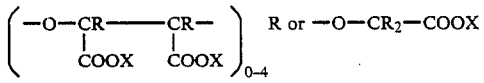

wherein each X is H or a salt-forming cation and n is from 0 to 4. These ether carboxylate builder acids or salts thereof are hereinafter designated as "EPB". "EPB" is used to designate both the acid and salt forms of these materials. When one of the R groups at either end is OH, n is 1, and the other R's and $R^1$ are H, the material is identified as TMS. When all R's are H and n is 2 the material is identified as TDS.

One preferred composition contains at least 26% by weight of the ether polycarboxylate builder. Another contains from about 5% to about 35% organic salt of citrate. Yet another contains from about 3% to about 25% ether polycarboxylate and from about 1% to about 15% organic salt of citrate, more preferably from about 5% to about 15% ether polycarboxylate with citrate with a ratio of 2:1 to 1:2.

It is an additional advantage of the EPBs that they provide synergistic cleaning performance when combined with the aluminosilicate derergency builder, especially hydrated Zeolite A with a particle size of less than about 5 microns. The benefit is greatest for lower levels of EPBs up to a 1:1 ratio of EPB to aluminosilicate.

The EPB component can be employed in the compositions herein in their free acid form, i.e., wherein X in the structural formulas is H. Alternatively, and preferably, these materials can be partially or fully neutralized to a tartrate monosuccinate salt. Preferred salt-forming cations useful in forming the neutralized materials are those which yield substantially water-soluble salts of tartrate monosuccinic acid. Examples of such preferred salt-forming cations include alkali metal (e.g., sodium, potassium, lithium), $C_1$–$C_4$ alkyl substituted ammonium and $C_1$–$C_4$ alkanolammonium. The most preferred salt-forming cations are sodium, potassium, monoethanolammonium and triethanolammonium.

Specific preferred examples of ether polycarboxylate detergency builders, processes for making them, etc. are disclosed in U.S. patent application Ser. No. 823,909, filed Jan. 30, 1986, by Rodney D. Bush, Daniel S. Connor, Stephen W. Heinzman, and Larry N. Mackey, entitled "Ether Carboxylate Detergency Builders and Process for Their Preparation," now U.S. Pat. No. 4,663,071, issued May 5, 1987, said patent being incorporated herein by reference. Other ether polycarboxylate detergency builders useful herein are disclosed in U.S. Pat. Nos. 3,635,830, Lamberti et al., issued Jan. 18, 1972; 3,784,486, Nelson et al., issued Jan. 8, 1974; 4,021,376, Lamberti et al., issued May 3, 1977; 3,965,169, Stahlheber, issued June 22, 1976; 3,970,698, Lannert, issued July 20, 1976; 4,566,984; Bush, issued Jan. 28, 1986; and 4,066,687, Nelson et al., issued Jan. 3, 1978; all of said patents being incorporated herein by reference.

Organic Surfactant

The detergent compositions herein contain from about 5% to about 45% by weight of an organic surfactant selected from the group consisting of anionic, nonionic, zwitterionic, ampholytic and cationic surfactants, and mixtures thereof. The surfactant preferably represents from about 5% to about 45%, and more preferably from about 8% to about 35%, most preferably from about 20 to about 30% by weight of the detergent composition. Surfactants useful herein are listed in U.S. Pat. No. 3,664,961, Norris, issued May 23, 1972, and in U.S. Pat. No. 3,929,678, Laughlin et al., issued Dec. 30, 1975, both incorporated herein by reference. Useful cationic surfactants also include those described in U.S. Pat. No. 4,222,905, Cockrell, issued Sept. 16, 1980, and in U.S. Pat. No. 4,239,659, Murphy, issued Dec. 16, 1980, both incorporated herein by reference. However, cationic surfactants are generally less compatible with the aluminosilicate materials herein, and thus are preferably used at low levels, if at all, in the present compositions. The following are representative examples of surfactants useful in the present compositions.

Water-soluble salts of the higher fatty acids, i.e., "soaps," are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, or organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkyl benzene sulfonates in which the alkyl group contains from about 9 to about 15 carbon atoms, in straight or branched chain configuration, e.g., those of the type described in U.S. Pat. Nos. 2,220,099 and 2,477,383. Especially valuable are linear straight chain alkyl benzene sulfonates in which the average number of carbon atoms in the alkyl group is from about 11 to 13, abbreviated as $C_{11}$–$C_{13}$ LAS.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing from about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to 23 carbon atoms in the alkane moiety; alkyl ether sulfates containing from about 10 to 20 carbon atoms in the alkyl group and from about 1 to 30 moles of ethylene oxide; water-soluble salts of olefin sulfonates containing from about 12 to 24 carbon atoms; and beta-alkyloxy alkane sulfonates containing from about 1 to 3 carbon atoms in the alkyl group and from about 8 to about 20 carbon atoms in the alkane moiety.

Water-soluble nonionic surfactants are also useful in the compositions of the invention. Such nonionic materials include compounds produced by the condensation of alkylene oxide groups (hydrophilic in nature) with an organic hydrophobic compound, which may be aliphatic of alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 12 moles of ethylene oxide per mole of alkyl phenol.

Preferred nonionics are the water-soluble condensation products of aliphatic alcohols containing from 8 to 22 carbon atoms, in either straight chain or branched configuration, with from 3 to 12 moles of ethylene oxide per mole of alcohol. Particularly preferred are the condensation products of alcohols having an alkyl group containing from about 9 to 15 carbon atoms with from about 3 to 8 moles of ethylene oxide per mole of alcohol.

Semi-polar nonionic surfactants include water-soluble amine oxides containing one alkyl moiety of from about 10 to 18 carbon atoms and 2 moieties selected from the group consisting of alkyl groups and hydroxyalkyl groups containing from 1 to about 3 carbon atoms; water-soluble phosphine oxides containing one alkyl moiety of about 10 to 18 carbon atoms and 2 moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic or aliphatic derivatives of heterocyclic secondary and tertiary amines in which the aliphatic moiety can be either straight or branched chain and wherein one of the aliphatic substituents contains from about 8 to 18 carbon atoms and at least one aliphatic substituent contains an anionic water-solubilizing group.

Zwitterionic surfactants include derivatives of aliphatic quaternary ammonium phosphonium, and sulfonium compounds in which one of the aliphatic substituents contains from about 8 to 18 carbon atoms.

Particularly preferred surfactants herein include linear alkylbenzene sulfonates containing from about 11 to 14 carbon atoms in the alkyl group; tallowalkyl sulfates; coconutalkyl glyceryl ether sulfonates; alkyl ether sulfates wherein the alkyl moiety contains from about 14 to 18 carbon atoms and wherein the average degree of ethoxylation is from about 1 to 4; olefin or paraffin sulfonates containing from about 14 to 16 carbon atoms; alkyldimethylamine oxides wherein the alkyl group contains from about 11 to 16 carbon atoms; alkyldimethylammonio propane sulfonates and alkyldimethylammonio hydroxy propane sulfonates wherein the alkyl group contains from about 14 to 18 carbon atoms; soaps of higher fatty acids containing from about 12 to 18 carbon atoms; condensation products of $C_9$–$C_{15}$ alcohols with from about 3 to 8 moles of ethylene oxide, and mixtures thereof.

Specific preferred surfactants for use herein include: sodium linear $C_{11}$–$C_{13}$ alkylbenzene sulfonate; triethanolammonium $C_{11}$–$C_{13}$ alkylbenzene sulfonate; sodium tallow alkyl sulfate; sodium coconut alkyl glyceryl ether sulfonate; the sodium salt of a sulfated condensation product of a tallow alcohol with about 4 moles of ethylene oxide; the condensation product of a coconut fatty alcohol with about 6 moles of ethylene oxide; the condensation product of tallow fatty alcohol with about 11 moles of ethylene oxide; the condensation of a fatty alcohol containing from about 14 to about 15 carbon atoms with about 7 moles of ethylene oxide; the condensation product of a $C_{12}$–$C_{13}$ fatty alcohol with about 3 moles of ethylene oxide; 3-(N,N-dimethyl-N-coconutalkylammonio)-2-hydroxypropane-1-sulfonate;

3-(N,N-dimethyl-N-coconutalkylammonio)-propane-1-sulfonate; 6-(N-dodecylbenzyl-N,N-dimethylammonio) hexanoate; dodecyldimethylamine oxide; coconutalkyldimethylamine oxide; and the water-soluble sodium and potassium salts of coconut and tallow fatty acids.

Aluminosilicate Ion Exchange Material

The detergent compositions herein can also contain from 0% to about 30%, preferably from about 5% to about 25%, and more preferably from about 5% to about 20%, by weight of crystalline aluminosilicate ion exchange material of the formula $$Na_z[(AlO_2)_z \cdot (SiO_2)_y] \cdot xH_2O$$

wherein z and y are at least about 6, the molar ratio of z and y is from about 1.0 to about 0.5 and x is from about 10 to about 264. Amorphous hydrated aluminosilicate materials useful herein have the empirical formula $$M_z(zAlO_2 \cdot ySiO_2)$$

wherein M is sodium, potassium, ammonium or substituted ammonium, z is from about 0.5 to about 2 and y is 1, said material having a magnesium ion exchange capacity of at least about 50 milligram equivalents of $CaCO_3$ hardness per gram of anhydrous aluminosilicate. Hydrated sodium Zeolite A with a particle size of from about 1 to 10 microns is preferred.

The aluminosilicate ion exchange builder materials herein are in hydrated form and contain from about 10% to about 28% of water by weight if crystalline, and potentially even higher amounts of water if amorphous. Highly preferred crystalline aluminosilicate ion exchange materials contain from about 18% to about 22% water in their crystal matrix. The crystalline aluminosilicate ion exchange materials are further characterized by a particle size diameter of from about 0.1 micron to about 10 microns. Amorphous materials are often smaller, e.g., down to less than about 0.01 micron. Preferred ion exchange materials have a particle size diameter of from about 0.2 micron to about 4 microns. The term "particle size diameter" herein represents the average particle size diameter by weight of a given ion exchange material as determined by conventional analytical techniques such as, for example, microscopic determination utilizing a scanning electron microscope. The crystalline aluminosillicate ion exchange materials herein are usually further characterized by their calcium ioin exchange capacity, which is at least about 200 mg equivalent of $CaCO_3$ water hardness/g of aluminosilicate, calculated on an anhydrous basis, and which generally is in the range of from about 300 mg eq./g to about 352 mg eq./g. The aluminosilicate ion exchange materials herein are still further characterized by their calcium ion exchange rate which is at least about 2 grains $Ca^{++}$/gallon/minute/gram/gallon of aluminosilicate (anhydrous basis), and generally lies within the range of from about 2 grains/gallon/minute/gram/gallon to about 6 grains/gallon/minute/gram/gallon, based on calcium ion hardness. Optimum aluminosilicate for builder purposes exhibit a calcium ion exchange rate of at least about 4 grains/gallon/minute/gram/gallon.

The amorphous aluminosilicate ion exchange materials usually have a $Mg^{++}$ exchange of at least about 50 mg eq. $CaCO_3$/g (12 mg $Mg^{++}$/g) and a $Mg^{++}$ exchange rate of at least about 1 grain/gallon/minute/gram/gallon. Amorphous materials do not exhibit an observable diffraction pattern when examined by Cu radiation (1.54 Angstrom Units).

Aluminosilicate ion exchange materials useful in the practice of this invention are commercially available. The aluminosilicates useful in this invention can be crystalline or amorphous in structure and can be naturally occurring aluminosilicates or synthetically derived. A method for producing aluminosilicate ion exchange materials is discussed in U.S. Pat. No. 3,985,669, Krummel et al., issued Oct. 12, 1976, incorporated herein by reference. Preferred synthetic crystalline aluminosilicate ion exchange materials useful herein are available under the designations Zeolite A, Zeolite B, and Zeolite X. In an especially preferred embodiment, the crystalline aluminosilicate ion exchange material has the formula $$Na_{12}[(AlO_2)_{12}(SiO_2)_{12}] \cdot xH_2O$$

wherein x is from about 20 to about 30, especially about 27 and has a particle size generally less than about 5 microns.

Disposable Dispenser Pouches

One type of dispenser for introducing laundry actives into the wash water in automatic washers is a free-bodied dispenser disclosed in U.S. Pat. No. 4,348,293, Clarke et al., issued Sept. 7, 1982, and commonly assigned U.S. patent application Ser. No. 017,103, Hortel et al., filed Feb. 19, 1987, now U.S. Pat. No. 4,740,326, issued Apr. 26, 1988, both incorporated herein by reference. A prefered disposable dispenser is designed to be removably attached to the central agitating post of a washing machine for dispensing a laundry active, e.g., a detergent or bleach, into the wash water of the machine.

According to the invention herein, a preferred disposable dispenser is provided for the dispensing of a laundry active during the wash period of an automatic clothes washing machine having an upright central agitating post. The dispenser comprises a sealed water-permeable, water-insoluble pouch or container, adaptable to being fastened onto the central agitating post and having disposed therein a laundry additive. The laundry active dissolves out of said water-permeable container by force of the agitating post and wash water. By employing such a dispenser, the consumer can be given the improved solubility performance as from free-bodied contained laundry active dispensers, and at the same time obtain the convenience of nonhandling of the laundry active itself, and the ease of disposing the container once it has been used. Moreover, such a dispenser is easy to handle, economical to manufacture at a low cost to the consumer, and safe to use.

For the purposes of expediency, the invention can be best explained and described by referring to a preferred embodiment thereof which is the subject matter of the accompanying drawings. it is to be understood that the scope of the invention is not to be limited thereto.

Figure 1:
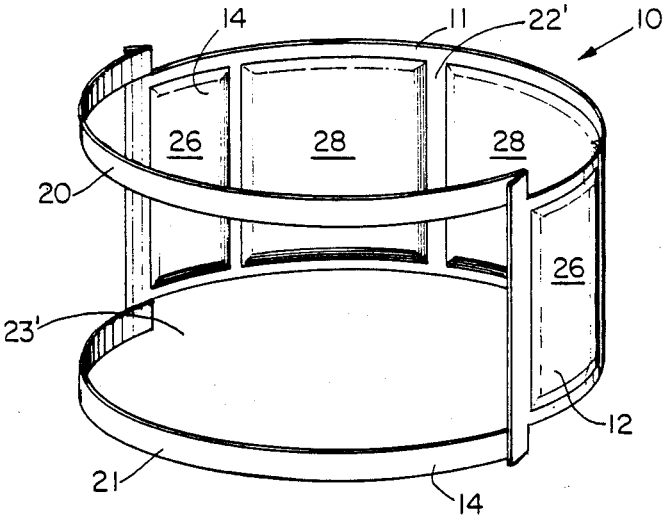
FIG. 1 is a perspective view of a water-permeable, water-insoluble laundry active dispenser with central agitating post loops and containing pouched laundry actives, which is a preferred pouched dispenser.

Referring now to FIGS. 1 and 2, a preferred embodiment of a laundry active dispenser 10 is shown having two equal laminated rectangular sheets, 12 and 14. The sheets are made of a flexible laminar water-permeable, water-insoluble material permanently sealed together at their peripheral edges 11, in this particular instance, by means of a continuous heat seal 16. It is not intended, however, to limit the present embodiment to such flexible laminar materials, or to the provision of a heat sealing means. Referring to FIG. 1, the two laminar sheets are also joined together by means of heat seals 16 and 18 to divide the dispenser 10 into four rectangular container pouches 26 and 28'.

Referring to FIGS. 1 and 2, the preferred dispenser is made by first embossing one of the substrate sheets, e.g., 14, to form deeper pochets for the pouches to contain the laundry active ingredients. Next, the ingredients are placed in the indentations created by the embossing. A sheet of polyethylene film (not shown) can be precut to match the seal areas 16 and 18 which are around and between the pouch pockets 26 and 28. This sheet is placed in position to line up with the embossed sheet. The second sheet 12 is then put in place and heat is applied to the embossed sheet. The heat melts the polyethylene film and seals the laundry actives inside the pouched pockets. The seals 16 and 18, in conjunction with the laminar sheets 12 and 14, form the sealed container pouches 26 and 28 having the laundry additives 29 and 31 disposed therein. See U.S. Pat. No. 4,638,907, Bedenk et al., issued Jan. 27, 1987, incorporated herein by reference, for more details on how embossed, pouched laminated dispensers are made.

Figure 3:
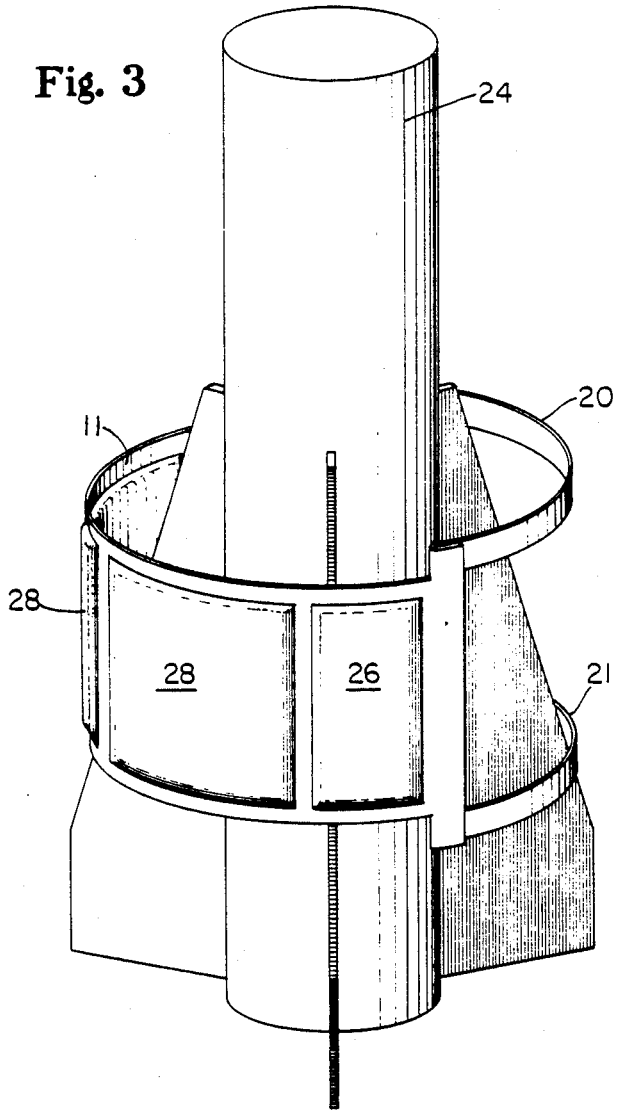
FIG. 3 is a perspective view of the laundry active dispenser of FIG. 1 positioned about a central agitating post of an automatic clothes washing machine.

The top and bottom peripheral edges 20 and 21 have slits 22 and 23 so as when opened, circular loops 22' and 23' are formed which are large enough to be loosely fitted (fastened) about the central agitating post 24 of an automatic clothes washing machine (see FIG. 3). An advantage of having two circular loops 22' and 23' is that the dispenser 10 is held more closely to the agitator. In a modified dispenser 10, the container pouches 26 and 28 can be designed so that the dispenser is perforated (not shown) so it could be torn in half or used in larger or smaller loads. Each half would have a circular loop for fastening to the agitator post.

In order to provide dissolution and egress of the laundry actives 29 and 31 from their container pouches 26 and 28 into the automatic clothes washing machine (not shown) during the operation of the wash period, at least one of the two sheets 12 and 14 that forms the container pouches 26 and 27 of the dispenser 10 is water-permeable. It will be noted that the slits 22 and 23 do not extend across the entire length of the sheets' peripheral edges 11. The object to be kept in mind, in accordance with the invention, is to provide a means to fasten the dispenser to the central post 24 to allow the laundry active to dispense from its container pouches in response to the movement of the central agitating post. Preferably, the seals do not rupture. Accordingly, the nature of materials used for making the dispenser 10 should be so selected.

Accordingly, the operation of the preferred laundry active dispenser is simply begun by looping the dispenser onto the central agitating post 24, preferably before the operation of the machine has been initiated, in the manner shown in FIG. 3. Once the machine is started, it will be seen that the dispenser is activated by the wash period of the automatic washer. After the automatic washer has gone through its complete operation, the used dispenser can be lifted off the central agitating post and discarded or placed in the dryer with the washed fabrics.

In view of what has been described hereinbefore as a preferred embodiment, it will be appreciated that other forms and embodiments are also within the scope of the present invention. Several of the critical features that must be inherent in the type of dispenser previously described and employed to dispense the laundry additive are that the laundry active(s) can be coated on or completely enclosed in the dispenser for release in the wash cycle. There must be a potential for water-permeability in the unit to allow dissolution and egress of the laundry active(s) into the wash aided by the agitation force of the central agitating post acting upon the unit.

Accordingly, any number of materials other than a flexible laminar nonwoven substance can be used for the container to enclose the laundry active, for example, porous metal foils, porous plastic bags, and the like. The material used, however, must be compatible with the nature of the laundry active which it is to contain, so that the chemical or physical identity of the container itself or the laundry active is not altered.

With the above in mind, other materials can be used, such as porous foil sheeting, paper sheeting, porous plastic boxes, nonwoven or woven cloth sheeting.

With regard to the attachment of fastening of the dispenser to the central agitating post of the automatic washer, any number of methods or means that are compatible with the dispenser design and provides for a means to fasten the dispenser to allow exit of the active from the water-permeable, water-insoluble container into the wash water through agitation force can be used. See U.S. Pat. No. 4,026,131, supra, for suitable fastening means designs.

In addition to the above embodiments, the present invention can be combined with dispenser devices which are activated in the spin period or the rinse period of the washing machine operation or the drying operation. In this respect, reference is made to U.S. Pat. No. 4,026,131, supra, and commonly assigned U.S. Ser. No. 017,103, Hortel et al., supra, now U.S. Pat. No. 4,740,326, issued Apr. 26, 1988, both incorporated herein by reference in their entirety.

EXAMPLE 1

One example of the present invention is a laundry active dispenser 10 shown in FIGS. 1, 2 and 3. This laundry active dispenser has been constructed so it can be packed flat and when used easily slipped over the top of the washing machine central post agitator, where it remains throughout the wash cycle. Dispenser 10 is 4½ inches (11.4 cm) tall. The circumferences of loops 22' and 23' are about 21 inches (5.3 cm), which is large enough to easily fit over virtually every washing machine central post agitator. It is also large enough to slip half way or more down on the central post agitator so that when the consumer wants to use the machine to wash a small load, which requires low water fills, the dispenser and its contained laundry additives will be submerged and can dissolve.

This example is constructed of materials that are strong enough to survive the reciprocal agitation and centrifugal spin forces of the washer cycle. It is then put in the dryer along with the wet laundry to dispense water-insoluble through the wash and rinse fabric softening and antistatic agents that have been designed to survive the wash and be activated by the heat of the dryer. The substrate used in this example is a spunbonded polyester nonwoven supplied by DuPont under the trade name Reemay® 2420. For a list of suitable detergent and bleach additives, softeners and substrates, see U.S. Ser. No. 017,103, supra, now U.S. Pat. No. 4,740,326, issued Apr. 26, 1988, incorporated herein by reference.

This dispenser 10 also has multiple pouches (pockets). Each one can be used to hold one or more laundry actives, for example, laundry detergent, bleach, enzymes, optical brightners, builders and other chemicals used to clean and condition laundry in the washer.

Optionals

Other ingredients commonly used in detergent compositions can be included in the compositions of the present invention. These include flow aids, color speckles, bleaching agents and bleach activators, suds boosters or suds suppressors, antitarnish and anticorrosion agents, soil suspending agents, soil release agents, dyes, fillers, optical brightners, germicides, pH adjusting agents, nonbuilder alkalinity sources, hydrotropes, enzymes, enzyme-stabilizing agents, chelating agents and perfumes.

The compositions of this invention need not be packaged in containers with good or excellent moisture barrier properties by virtue of unit doses contained in pouches.

Materials like sodium perborate tetrahydrate and monohydrate can be admixed with the granular detergent compositions of this invention. Other materials include enzymes, solid hydrogen peroxide sources, hydrogen peroxide activators, and silicone suds suppressors.

The following nonlimiting examples illustrate the detergent compositions of the present invention.

All percentages, parts, and ratios used herein are by weight unless otherwise specified.

TABLE 1

| | Formula Examples (by parts) | | | |
|---|---|---|---|---|
| | No. 1 | No. 2 | No. 3 | No. 4 |
| $C_{13}$ Linear alkyl benzene sulfonate | 13.7 | 11.2 | 10.1 | 15.0 |
| $C_{14}$–$C_{15}$ Alkyl sulfate | 13.7 | 11.2 | 10.1 | 15.0 |
| Sodium sulfate | 17.8 | 14.5 | 13.2 | 19.5 |
| Tergitol 80-L50N* | 2.1 | 1.8 | 1.6 | 2.3 |
| Sodium polyacrylate (Avg. M.W. approx. 4500) | 1.6 | 1.3 | 1.1 | 1.7 |
| Polyethylene glycol (Avg. M.W. approx. 8000) | 1.6 | 1.3 | 1.1 | 1.7 |
| Ether polycarboxylate builder TMS/TDS, sodium salt 86:14 weight ratio TMS:TDS | 10.6 | 31.8 | 30.1 | 0.0 |
| Zeolite A** | 15.8 | 13.0 | 11.7 | 17.3 |
| Sodium citrate | 9.5 | 0.0 | 6.9 | 20.2 |
| Impurities, etc. | 6.4 | 7.0 | 7.0 | 0.0 |
| Unreacted | 0.6 | 0.6 | 0.5 | 0.8 |
| Water | 6.4 | 6.4 | 6.4 | 6.4 |

*Tergitol 80-L50N is an ethoxylated/propoxylated 5.3 EO and 0.9 PO, approximately with alkyl chain lengths of $C_8$ (20%) to $C_{10}$ (80%).
**Zeolite A is defined hereinabove.

The above formulas are prepared by making a crutcher mix of the base granule ingredients with a water level at about 40% and spray drying. It highly desirable to insure good initial flowability by adding a flow aid, 0.1–1 parts, to the spray dried granules. Some preferred flow aids are anhydrous and particulate colloidal silica, e.g., Cab-O-Sil (Cabot Corp.) and Sipernatt, available commercially. The spray dried base granules are packaged in water-permeable, water-insoluble unit dose pouches. It is also desirable to admix any optionals to the base granules prior to pouching.

The pouched base detergent granule compositions of the present invention are initially free flowing, but become lumpy or sticky upon storage under stress conditions, e.g., 80° F. (27° C.)/60–80% relative humidity. One test is to store the pouches in a closed cardboard box for a period of several weeks. The pouches are then examined for caking and stickiness after the first, second and fourth weeks. The pouches are also tested for dust grades. The pouched compositions of the present invention provide very good detergent solubility with improved dusting after stress storage, notwithstanding the development of lumpiness.

What is claimed is:

1. A through-the-wash disposable detergent dispenser comprising:

I. a porous, water-permeable, water-insoluble pouch said pouch comprising a spun-bonded polyester non woven;

II. a unit dose amount of hygroscopic granular detergent composition contained in said pouch; said pouch having seals which are designed not to rupture during the wash; said composition comprising:

(a) from about 5% to about 45% by weight of an organic surfactant selected from the group consisting of anionic, nonionic, zwitterionic, ampholytic and cationic surfactants, and mixtures thereof;

(b) from about 5% to about 75% by weight of water-soluble neutral or alkaline salt comprising from about 1% to about 55%, by weight of the granular detergent composition, of a hygroscopic builder salt selected from the group consisting of: salts of citrate, formate, malate, succinate, acetate, tartrate, and ether polycarboxylate having the formula:

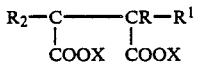

wherein R is selected from the group consisting of H, and OH with no more than one OH group being attached to any one carbon atom; $R^1$ is either a group having the formula

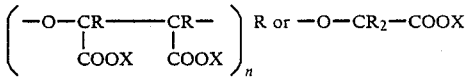

wherein each X is selected from the group consisting of H and cations which make the ether polycarboxylate builder water soluble and n is from 0 to 4; and said composition contains less than about 10% by weight of phosphate materials, said composition being formed by drying a concentrated aqueous slurry comprising the above components; and (c) from 0% to about 30% by weight of a finely divided aluminosilicate ion exchange material selected from the group consisting of:

(1) crystalline aluminosilicate material of the formula:

$$Na_z[(AlO_2)_z.(SiO_2)_y].xH_2O$$

wherein z and y are at least 6, the molar ratio of z to y is from 1.0 to 0.5 and x is from 10 to 264, said material having a particle size diameter of from about 0.1 micron to about 10 microns, a calcium ion exchange capacity of at least about 200 mg $CaCO_3$ eq./g and a calcium ion exchange rate of at least about 2 grains $Ca^{++}$/gallon/minute/gram/gallon;

(2) amorphous hydrated aluminosilicate material of the empirical formula:

$$M_z(zAlO_2 \cdot ySiO_2)$$

wherein M is sodium, potassium, ammonium, or substituted ammonium, z is from about 0.5 to about 2 and y is 1, said material having a magnesium ion exchange capacity of at least about 50 milligram equivalents of $CaCO_3$ hardness per gram of anhydrous aluminosilicate and a $Mg^{++}$ exchange rate of at least about 1 grain/gallon/minute/gram/gallon; and (3) mixtures thereof; and wherein said hygroscopic detergent is initially free flowing granules when first pouched, but said granules become lumpy/sticky upon storage at 27° C. and 60–80% relative humidity.

2. A porous, pouched detergent composition according to claim 1 comprising from about 20% to about 35% by weight of said organic surfactant and said pouch comprises a water-permeable, water-insoluble substrate.

3. A porous, pouched detergent composition according to claim 1 wherein said organic surfactant is selected from the group consisting of linear alkylbenzene sulfonates containing from about 11 to 14 carbon atoms in the alkyl group, tallowalkyl sulfates; coconutalkyl glyceryl ether sulfonates; alkyl ether sulfates wherein the alkyl moiety contains from about 14 to 18 carbon atoms and wherein the average degree of ethoxylation is from about 1 to 4; olefin or paraffin sulfonates containing from about 14 to 16 carbon atoms; alkyldimethyl amine oxides wherein the alkyl group contains from about 11 to 16 carbon atoms; alkyldimethylammonio propane sulfonates and alkyldimethylammonio hydroxy propane sulfonates wherein the alkyl group contains from about 14 to 18 carbon atoms; soaps of higher fatty acids containing from about 12 to 18 carbon atoms; condensation products of $C_9$–$C_{15}$ alcohols with from about 4 to 8 moles of ethylene oxide, and mixtures thereof.

4. A porous, pouched detergent composition according to claim 1 comprising from about 5 to about 25% by weight of said crystalline aluminosilicate material and wherein said crystalline aluminosilicate material is of the formula $$Na_{12}[(AlO_2)_{12}(SiO_2)_{12}] \cdot xH_2O$$

wherein x is from about 20 to about 30.

5. A porous, pouched detergent composition according to claim 1 comprising from about 3% to about 25% by weight of said ether polycarboxylate builder and from about 1% to about 25% by weight of an organic salt of citrate.

6. A porous, pouched detergent composition according to claim 1 comprising from about 5% to about 15% by weight of said ether polycarboxylate builder wherein said polycarboxylate and said citrate have a ratio of from about 2:1 to 1:2.

7. A porous, pouched detergent composition according to claim 1 comprising from about 10% to about 60% by weight of said water-soluble neutral or alkaline salt and wherein the water-soluble neutral or alkaline salt comprises sodium sulfate and from about 3% to about 20% by weight of said ether polycarboxylate builder.

8. A porous, pouched detergent composition according to claim 1 containing from 0% up to less than about 5% by weight of phosphate materials and from 0% up to less than about 4% by weight of alkali metal silicate materials.

9. A porous, pouched detergent composition according to claim 1 comprising at least 26% by weight of said ether polycarboxylate builder.

10. A porous, pouched detergent composition according to claim 1 containing from about 5% to about 35% by weight said organic salt of citrate.

* * * * *

UNITED STATES PATENT AND TRADEMARK OFFICE

CERTIFICATE OF CORRECTION

PATENT NO. : 4,925,586

DATED : May 15, 1990

INVENTOR(S) : Keith H. Baker; Stephen W. Snyder; & Allen D. Clauss

It is certified that error appears in the above-identified patent and that said Letters Patent is hereby corrected as shown below:

Col. 3, line 43, "%" should read -- 0% --.

Col. 3, line 66, "delinquescent" should read -- deliquescent --.

Col. 5, line 52, "carboxylate" should read -- polycarboxylate --.

Col. 7, line 44, "9 to 23" should read -- 9 to about 23 --.

Col. 9, lines 17-18, "of z and y is" should read -- of z to y is --.

Col. 9, line 47, "aluminosillicate" should read -- aluminosilicate --.

Col. 9, line 49, "ioin" should read -- ion --.

Signed and Sealed this

Twenty-first Day of September, 1993

Bruce Lehman

*Attest:*

BRUCE LEHMAN

*Attesting Officer*

*Commissioner of Patents and Trademarks*